United States Patent [19]

Fedrowitz et al.

[11] 3,963,528

[45] June 15, 1976

[54] OXIDATION OF CHROMIUM SURFACES

[75] Inventors: Walter Fedrowitz, Wappingers Falls; Rudolf G. Frieser, Poughkeepsie, both of N.Y.

[73] Assignee: International Business Machines Corporation, Armonk, N.Y.

[22] Filed: Mar. 24, 1975

[21] Appl. No.: 561,260

[52] U.S. Cl. ..... 148/6.14 R; 148/31.5

[51] Int. Cl.[2] ..... C23F 7/02

[58] Field of Search ..... 148/6.14 R; 204/35 R, 204/38 R

[56] References Cited

UNITED STATES PATENTS

| | | | |
|---|---|---|---|
| 2,312,066 | 2/1943 | Batcheller | 148/6.14 R |
| 2,317,205 | 4/1943 | Lowit | 148/6.14 R |
| 3,698,928 | 10/1972 | Blome | 350/276 |

*Primary Examiner*—Ralph S. Kendall

*Attorney, Agent, or Firm*—George O. Saile

[57] ABSTRACT

A method for forming an oxidized chromium film on the surface of chromium metal in a controlled manner which involves the use of a permanganate solution. The chromium metal film is first subjected to a basic hydrogen peroxide solution. The chromium surface is then removed from the hydrogen peroxide solution and immersed in an aqueous permanganate solution maintained at a temperature less than about 100° C. for a time preferably within 1 to 5 minutes. At this time the chromium film has been oxidized to the desired thickness depending upon the time and temperature at which the surface has been subjected to the solutions. The surface is removed from the permanganate solution and dried. Should additional thickness of chromium oxide films be desired, the surface is intermittently subjected to the permanganate solution and dried to build up the desired thickness of chromium oxide.

9 Claims, 1 Drawing Figure

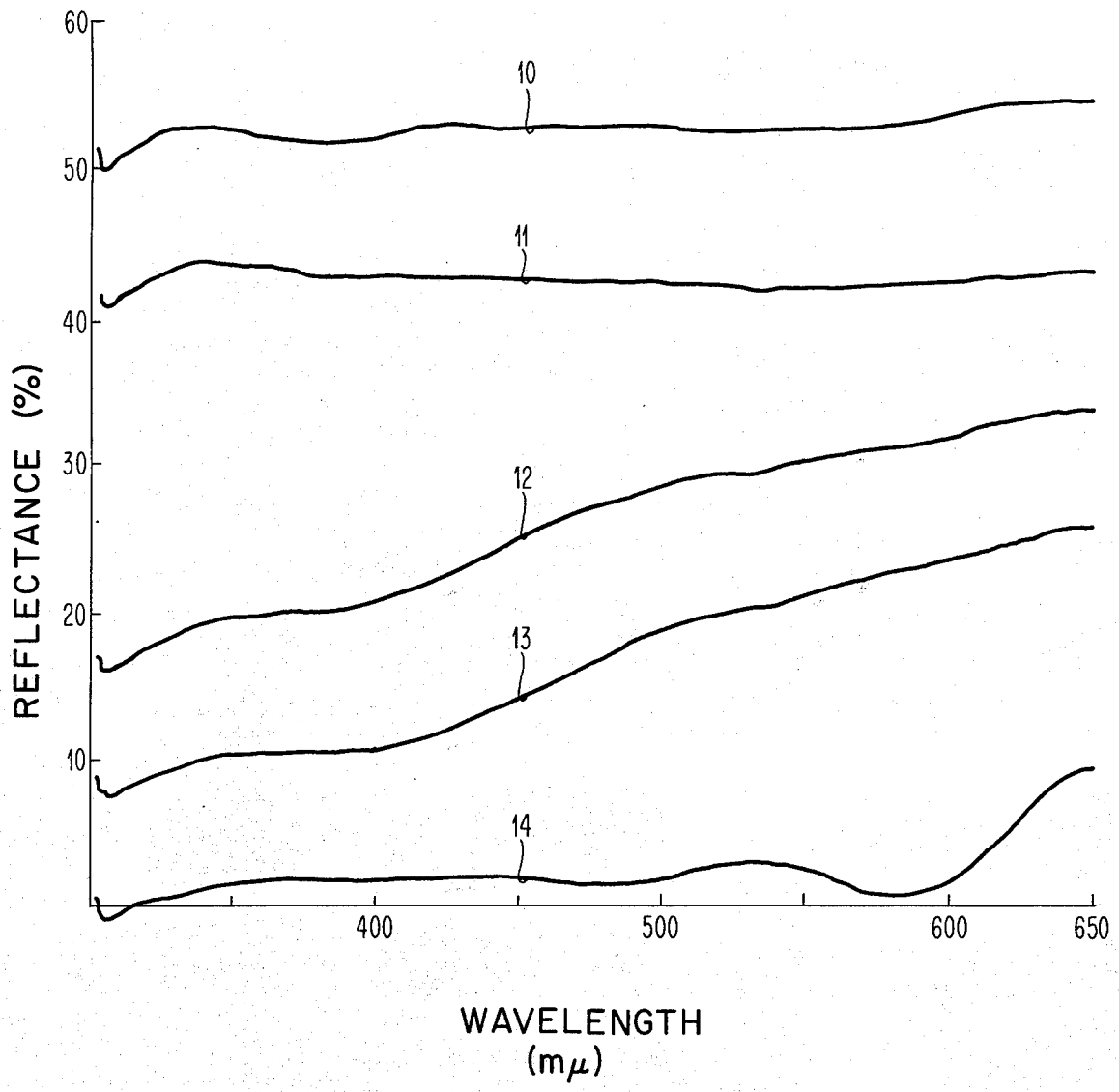
60
50
40
30
20
10
REFLECTANCE (%)
10
11
12
13
14
400
500
600
650
WAVELENGTH
(mμ)

OXIDATION OF CHROMIUM SURFACES

BACKGROUND OF THE INVENTION

The invention relates to methods for oxidizing chromium surfaces in a controllable manner so that the chromium surface can be protected from corrosive attack, reducing the reflectivity of a chromium surface used in photolithography or other purposes.

DESCRIPTION OF THE PRIOR ART

Normally, chromium metallic surfaces are left untreated and are preferably unoxidized. Chromium has a highly metallic reflecting surface with about 50 to 60% of the impinging light being reflected in the range of 300 to 650 millimicrons (m$\mu$). Chromium is also a very chemically inert metal. In fact, in many applications, chromium is chosen because of its high metallic reflectivity and its notable lack of oxidizing or tarnishing.

There are some uses which require the formation of a chromium oxide or other oxides on the surface of chromium metal. The use of chromium films in photomasks is one area which has made it desirable to form a chromium oxide film on the surface of the chromium metal. These photomasks are used for the exposure of patterns of photoresist in photolithography operations in the manufacture of semiconductor devices. A problem which is inherent with metal masks, such as chromium, is that the light reflecting from the semiconductor surface strikes the face of the mask that is adjacent to the semiconductor surface and then is reflected down at an angle. This causes the original geometry that was to be transferred by the mask to become blurred with poor resulting resolution.

A solution to this problem has been the use of nonreflecting surfaces formed on the chromium or other metal mask layers. The U.S. Pat. No. 3,698,928 to E. R. Blome, dated Oct. 17, 1972, describes this problem. The patent describes the use of an antireflection material which is preferably chromium oxide. The patent describes the process by which the chromium oxide is formed as being by vacuum deposition on the metallic surface. The vacuum deposition process, however, subjects the surface to elevated temperatures and is virtually of necessity a batch type of operation.

SUMMARY OF THE PRESENT INVENTION

In accordance with the present invention, a controllable process for forming a substantially chromium oxide film on the surface of a chromium metal surface is described. The film is first subjected to a basic hydrogen peroxide solution and then subjected to an aqueous permanganate solution maintained at a suitable temperature and for a suitable time to produce the desired thickness of chromium oxide. By alternate subjection to the permanganate solution and the drying in nitrogen several times, the thickness of chromium oxide can be built up in such a manner so as to prevent a peeling or poor adhesion of the oxide coating to the chromium film.

BRIEF DESCRIPTION OF THE DRAWING

The FIGURE shows reflectance curves of the product produced by the various treatments as compared to an untreated chromium surface.

DESCRIPTION OF THE PREFERRED EMBODIMENTS

The chromium surface has to be treated before any oxidation thereof is possible. This is preferably accomplished by heating a clean chromium surface in a basic solution of hydrogen peroxide for typically 2 to 10 minutes at a temperature of 80° to 85° C. This treatment is believed to hydrate the native, thin layer of oxide which is always found on the surface of the metallic chromium, in addition to a further cleaning effect. The basic solution of the hydrogen peroxide can be made with either ammonium hydroxide, the sodium hydroxide or similar materials.

The actual oxidation of the chromium surface can be achieved in one of several ways. First, the permanganate oxidizing solution can be added to the basic peroxide solution at the end of 2 to 10 minutes of the peroxide cleaning cycle. Alternately, the pretreated and even wet chromium surface can be submerged in a heated permanganate solution. Better control of the oxidation reaction has been noted with the alternate technique and in particular where the treated chromium surface is dried in nitrogen prior to submersion in the permanganate solution. This drying step is advantageous in the improvement of the uniformity of the resulting films and the adhesion of the film to the chromium surface. The various water soluble permanganates include potassium, sodium and barium permanganates.

After the formation of the chromium oxide to the desired thickness, it is important to age the film at room temperature for about 24 hours. This is done to harden the oxides since they are hydrated at their formation. Water is removed by simple evaporation during the 24 hours.

The degree of oxidation of the chromium surfaces depend on the concentration of the permanganate solution, the length of time the mask is exposed to the solution, the temperature of the oxidizing solution, and the conditions of the hydrogen peroxide pretreatment. The hydrogen peroxide pretreatment solution is not just a cleaning step but has an effect upon the uniformity of films produced by the process. The temperature of the peroxide solution is limited by the basic material used. For example, where ammonium hydroxide is utilized, the solution boils at about 85°C. The preferred concentrations of the permanganate ion in the solution is $1\times10^{-3}$ to $1\times10^{-5}$ molar. Lower concentrations of the permanganate are too slow and do not produce an adequate oxide film in a reasonable time. Higher concentrations tend to produce films which do not ahere well to the chromium and peel off. Inadequate chromium oxide films have been found when the temperature of both process solutions are below 75° C. Also, the oxidation process was inadequate when the immersion time in the permanganate solution was less than about 1 minute. Temperatures greater than about 85° C. of the permanganate solution also resulted in poor adhesion of the oxide film to the chromium and the peeling of the film from the surface.

The thickness of the chromium oxide film can be estimated by its color. The article "Nondestructive Determination of Thickness and Reflective Index of Transparent Films" by W. A. Plisken and E. E. Conrad in IBM Journal of Research and Development, Vol. 8, No. 1, January 1964 at page 48 gives a color chart versus film thickness for silicon dioxide. Comparing the refractive indices of chromium oxide and silicon oxide of respectively 1.4 to 2.5 the film thickness versus color for chromium oxide would be about half that of silicon dioxide. This assumes the presence of manganese with chromium oxide films of the present invention has no signicant effect on the reflective index. For example, light yellow or gold is about 1000A and deep blue about 1600A.

The mechanism of the oxidation reaction is not well understood. It is known, however, that the basic pretreatment solution does lower the water contact angle of the surface. This suggests that the surface is hydrated and presumably coated with a thin film of chromium hydroxide which is gelatinous. Reducing the permanganate to one of the manganese oxides, $MnO_2$ or $Mn_2O_3$, in the presence of such a gelatinous layer would entrap some of the produced oxide and could account for the observed facts. The observed hardening or aging of the chromium oxide films give further support to this understanding of the reaction. Electron microprobe investigation of the oxidized chromium surfaces showed the presence of manganese which was not present on the untreated metallurgy. This shows that the chromium oxide produced by this method contains manganese.

The following examples are included merely to aid in the understanding of the invention and variations may be made by one skilled in the art without departing from the spirit and scope of the invention.

EXAMPLES 1–12

Identical clean chromium films of 1000A thickness on glass substrates were used in each of the Examples. Each of the films were then immersed in hydrogen peroxide-ammonium hydroxide solution for 5 to 10 minutes maintained at a temperature of 80°–85° C. The treating solution included 80 milliliters hydrogen peroxide (30% concentration) plus 35 milliliters ammonium hydroxide (approximately 30% concentration) which were brought to 1 liter with water. The film was removed from the peroxide solution. The chromium films were then, while still wet, immersed in potassium permanganate solution according to the concentration, time and temperature indicated in the Table 1. Following the oxidation, as indicated in Table 1, the oxidation reaction was quenched by placing the film into de-ionized water in an overflow tank and rinsed well. The oxidized and rinsed chromium was then dried in a stream of clean nitrogen. The films were allowed to age at room temperature for 24 house. The reduction of reflectance of the chromium film was measured according to the following procedure.

Using a Beckman DK2A Spectrophotometer with Reflection attachment, the treated samples were tested. The amount of light reflected was picked up by photocells. The signal was plotted as reflectivity vs. visible wavelength ($\eta$) of light at which it was absorbed. The instrument is calibrated to read 100% reflected with no sample in the light path. With a semireconstituted reading of the reduction of reflectivity was measured at 400 m$\mu$($\eta$) for conversion though the amount of reduction varied with $\eta$. The results are tabulated in Table I.

The FIGURE shows the reflectance curves of the various treatments of several of the Examples. The reflectance curve in percent is plotted against the wave length in micrometers. Curve 10 is the untreated chromium film, Curve 11 is the chromium film treated for 10 minutes at 80° C. in ammonium hydroxide and hydrogen peroxide treating solution, Curve 12 is Example 8, Curve 13 is Example 10, and Curve 14 is Example 6.

Examples 1–3, 6 and 7 used a 100°C. temperature and produced somewhat nonuniform films, but not unacceptable. Examples 4, 11 and 12 used room temperature and produced uniform, excellent films.

Table I

| Example | $KMnO_4$ Treatment Conc. Molarity | Time Min. | Temp. C° | Surface Condition | Reduction Final Readings At 400 m$\mu$ of % Reflectivity |
|---|---|---|---|---|---|
| 1 | $0.25\times10^{-3}$ | 0.5 | 100 | nonuniform | 25 |
| 2 | $0.25\times10^{-3}$ | 1.0 | 100 | nonuniform | 23 |
| 3 | $0.25\times10^{-3}$ | 5.0 | 100 | nonuniform | 20 |
| 4 | $0.25\times10^{-3}$ | 5.0 | R.T. | uniform | none |
| 5 | $1.2\times10^{-3}$ | 0.5 | 100 | uniform pale yellow | 23 |
| 6 | $1.2\times10^{-3}$ | 5.0 | 100 | nonuniform | 4% |
| 7 | $1.2\times10^{-3}$ | 10.0 | 100 | nonuniform | 14% |
| 8 | $1.2\times10^{-3}$ | 0.5 | 80 | uniform gold color | 21% |
| 9 | $1.2\times10^{-3}$ | 1.0 | 90 | nonuniform | 15% |
| 10 | $2.5\times10^{-4}$ | 1.0 | 80 | uniform dark gold | 12% |
| 11 | $2.5\times10^{-4}$ | 3.0 | 70 | nonuniform | 5% |
| 12 | $2.5\times10^{-5}$ | 2.0 | 70 | uniform | none |

EXAMPLES 13–17

Chromium films of a 1000A thickness on glass were utilized. Each of the films were rinsed in acetone at room temperature for about 1 minute, followed by rinsing in isopropyl alcohol at room temperature for 1 minute and finally rinsed in de-ionized water at room temperature for about 1 minute. The films were then immersed in hydrogen peroxide-ammonium hydroxide solution for 5 minutes at 85° C. The same proportion of solution described in Examples 1–12 were utilized in the present Examples. The materials used in the Examples, their concentrations, the times of exposure and temperature of exposure are listed in Table II for each of the Examples. The surface conditions of the resulting oxide film or lack of an oxide film is indicated in Table II. From these Examples, it is obvious that the sodium periodate and potassium perrhenate oxidizing agents do not operate to oxidize the chromium films.

This group of Examples was to prove or disprove operability of oxidizing materials and not to obtain uniform oxide films. Non-uniformity was a function of the original surface conditions and was undoubtedly caused by residual oils on the surface of the original chromium films.

Table II

| Example | Treatment Solution | Concentration | Time/ Min. | Temp. °C. | Surface Condition |
|---|---|---|---|---|---|
| 13 | Sodium Periodate $NaH_2IO_2$ | $2.5\times10^{-4}$ Molar | 1 | | No change |
| | | | 2 | | No change |
| | | | 3 | | No change |
| 14 | Potassium Perrhenate $KRcO_4$ | $2.5\times10^{-4}$ Molar | 1 | | No change |
| | | | 2 | | No change |
| | | | 3 | | No change |
| 15 | Sodium Permanganate $NaMnO_4$ | $2.5\times10^{-4}$ Molar | 1 | | Medium Gold-Uniform |
| | | | 2 | | Dark Gold-Uniform |
| | | | 2¼ | | Dark Gold w/bluish haze on edge |
| 16 | Barium Permanganate $Ba(MnO_4)_2$ | $2.5\times10^{-4}$ Molar | 1 | | Dark Gold-nonuniform |
| | | | 1½ | | Dark Gold & lt.bluish nonuniform |
| | | | 2 | | Bright Gold |

Table II-continued

| Example | Treatment Solution | Concentration | Time/ Min. | Temp. °C. | Surface Condition |
|---|---|---|---|---|---|
| | | | | | & nonuniform |
| 17 | Barium | $1.25\times10^{-4}$ | 1 | | Dark Gold- |
| | Permanganate | Molar | | | nonuniform |
| | | | 1¼ | | Dark Gold & lt.bluish nonuniform |
| | | | 1½ | | Medium Blue nonuniform |

EXAMPLE 18

A chromium mask containing fine line dimensions in mils was treated by the process of Example 10. Line dimensions ranging from one to two tenths of a mil were measured before and after treatment. Table III gives the results of this test. No significant changes in these dimensions were noted indicating that the oxidation reaction does not effect the dimensions nor change the geometry of the mask.

Table III

| Site | Before Small | Before Large | After Small | After Large |
|---|---|---|---|---|
| 1 | .209 ± .004 | 1.167 ± .006 | .209 ± .004 | 1.161 ± .003 |
| 2 | .201 ± .005 | 1.149 ± .005 | .197 ± .005 | 1.142 ± .004 |
| 3 | .197 ± .002 | 1.150 ± .002 | .206 ± .003 | 1.146 ± .005 |
| 4 | .200 ± .003 | 1.152 ± .005 | .206 ± .003 | 1.146 ± .001 |
| 5 | .205 ± .002 | 1.145 ± .003 | .208 ± .001 | 1.152 ± .005 |

While the invention has been particularly shown and described with reference to the preferred embodiments thereof, it will be understood that those skilled in the art that the changes in form and detail may be made therein without departing from the spirit and scope of the invention.

What is claimed is:

1. A method for forming an oxidized chromium film on the surface of chromium metal in a controlled manner comprising:

providing a chromium metal surface;

subjecting the said surface to a basic hydrogen peroxide solution;

removing the said surface from said hydrogen peroxide aolurion and immersing said surface in an aqueous permanganate solution maintained at a temperature less than about 100°C for a time less than 10 minutes to form an oxidized film;

the concentration of said permanganate solution is between about $10^{-3}$ to $10^{-5}$ molar; and removing the said surface from said permanganate solution and drying said oxidized chromium film.

2. The method of claim 1 wherein the said permanganate is potassium permanganate.

3. The method of claim 1 wherein the said permanganate is sodium permanganate.

4. The method of claim 1 wherein the said permanganate is barium permanganate.

5. The method of claim 1 wherein the temperature of the solutions is maintained between about 75° and 85° C.

6. The method of claim 1 wherein the said hydrogen peroxide solution is made basic by the addition of ammonium hydroxide.

7. The method of claim 1 wherein the said hydrogen peroxide solution is made basic by the addition of sodium hydroxide.

8. The method of claim 1 wherein the time of immersion in the said permanganate solution is between about 1 and 5 minutes.

9. The method of claim 1 wherein said drying is accomplished using nitrogen and an additional oxidized layer is formed by immersing the said surface into the said permanganate solution a second time.

* * * * *